US010269315B2

(12) United States Patent
Huang

(10) Patent No.: US 10,269,315 B2
(45) Date of Patent: Apr. 23, 2019

(54) DATA DRIVER AND LIQUID CRYSTAL DISPLAY HAVING THE SAME

(71) Applicant: Shenzhen China Star Optoelectronics Technology Co., Ltd., Shenzhen (CN)

(72) Inventor: Xiaoyu Huang, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 155 days.

(21) Appl. No.: 15/115,597

(22) PCT Filed: May 26, 2016

(86) PCT No.: PCT/CN2016/083506
§ 371 (c)(1),
(2) Date: Jul. 29, 2016

(87) PCT Pub. No.: WO2017/166412
PCT Pub. Date: Oct. 5, 2017

(65) Prior Publication Data

US 2018/0182323 A1 Jun. 28, 2018

(30) Foreign Application Priority Data

Mar. 30, 2016 (CN) ..... 2016 1 0190684

(51) Int. Cl.
*G09G 3/36* (2006.01)

(52) U.S. Cl.
CPC ..... *G09G 3/3614* (2013.01); *G09G 3/3688* (2013.01); *G09G 2310/027* (2013.01); *G09G 2310/0297* (2013.01)

(58) Field of Classification Search
CPC ..... G09G 3/3275; G09G 3/3614
See application file for complete search history.

(56) References Cited

U.S. PATENT DOCUMENTS 5,949,396 A * 9/1999 Lee ..... G09G 3/3688 345/87
8,736,532 B2 5/2014 Oh
(Continued)

FOREIGN PATENT DOCUMENTS

CN 1744183 A 3/2006
CN 101299324 11/2008
(Continued)

OTHER PUBLICATIONS

International Search Report for PCT/CN2016/083506, Completed by the Chinese Patent Office dated Dec. 30, 2016, 13 Pages.

*Primary Examiner* — Kevin M Nguyen
(74) *Attorney, Agent, or Firm* — Mintz Levin Cohn Ferris Glovsky and Popeo, P.C.; Kongsik Kim; Jhongwoo Jay Peck

(57) ABSTRACT

There provides a liquid crystal display and a data driver thereof. The data driver includes: an output module for outputting N groups of data voltage sets to N groups of data line sets; and N selection modules, each one corresponding to one group of data voltage set and one group of data line set; wherein each selection module selects data voltages of the corresponding group of data voltage set to provide to data lines in the corresponding group of data line set according to different control signals when the liquid crystal display drives pixels in different polarity reversal manners. The liquid crystal display and the data driver thereof in the present invention may achieve the goal of free switching between the single-point polarity reversal manner and the double-point polarity reversal manner.

17 Claims, 3 Drawing Sheets

(56) References Cited

U.S. PATENT DOCUMENTS

| | | | | |
|---|---|---|---|---|
| 9,001,089 | B2 | 4/2015 | Choi et al. | |
| 2006/0232539 | A1 | 10/2006 | Hashimoto | |
| 2008/0259016 | A1 | 10/2008 | Tanaka et al. | |
| 2010/0289786 | A1* | 11/2010 | Tanaka | G09G 3/3648 345/209 |
| 2015/0161927 | A1* | 6/2015 | Hekstra | G09G 3/3614 345/209 |
| 2015/0187292 | A1* | 7/2015 | Kim | G09G 3/3614 345/88 |

FOREIGN PATENT DOCUMENTS

| | | |
|---|---|---|
| CN | 101387804 | 3/2009 |
| CN | 102568421 | 7/2012 |
| CN | 103578432 | 2/2014 |
| CN | 104424898 | 3/2015 |
| CN | 105374332 A | 3/2016 |
| CN | 105609082 | 5/2016 |

* cited by examiner

DATA DRIVER AND LIQUID CRYSTAL DISPLAY HAVING THE SAME

CROSS-REFERENCE TO RELATED APPLICATION

This application is the U.S. national phase of PCT Application No. PCT/CN2016/083506 filed on May 26, 2016, which claims priority to CN Patent Application No. 201610190684.5 filed on Mar. 30, 2016, the disclosures of which are incorporated in their entirety by reference herein.

TECHNICAL FIELD

The present invention relates to a display, in particular to a data driver and a liquid crystal display having the same.

BACKGROUND ART

With development of photoelectricity and semiconductor technology, it has led to a growth in the booming of Flat Panel Display. Liquid Crystal Display (LCD for short) in numerals flat displays has been applied in various aspects of production and living for its favorable characteristics such as high efficient in space utilization, low power consumption, radiationless and low disturbance of electromagnetism etc.

In course of application, to avoid direct current blocking effect of liquid crystal pixel in the liquid crystal display and to prevent liquid crystal pixel polarization, a polarity reversal needs to be performed to the driving voltage provided to the liquid crystal pixel in course of display of the liquid crystal display. At present, the common way of polarity reversal in the liquid crystal display is a single-point polarity reversal, i.e., a voltage polarity stored in every liquid crystal pixel in the liquid crystal display is in contrast to the voltage polarities stored in the neighboring liquid crystal pixels around the liquid crystal pixel.

Although the display effect of the signal-point polarity reversal manner used in the liquid crystal display is the best among the existing polarity reversal manners, some defects such as cross talk, etc., associated with the single-point polarity reversal manner, may be generated in some special pictures. That needs to convert the signal-point polarity reversal manner into double-point polarity reversal manner in these special frames, i.e., a voltage polarity stored in every liquid crystal pixel set in the liquid crystal display is in contrast to the voltage polarities stored in the neighboring liquid crystal pixel sets around the liquid crystal pixel set, and each liquid crystal pixel set includes at least two liquid crystal pixels having the same voltage polarity.

Thus, it is necessary to provide a liquid crystal display capable of free switching between the single-point polarity reversal manner and the double-point polarity reversal manner.

SUMMARY

To solve the above problem existing in the prior art, an object of the present invention is to provide a data driver for a liquid crystal display, including: an output module for outputting N groups of data voltage sets to N groups of data line sets; and N selection modules, each one corresponding to a group of data voltage set and a group of data line set; wherein each selection module selects data voltages of the corresponding group of data voltage set to provide to data lines in the corresponding group of data line set according to different control signals when the liquid crystal display drives pixels in different polarity reversal manners.

Further, each selection module selects data voltages of the corresponding group of data voltage set to provide to data lines in the corresponding group of data line set according to different control signals when the liquid crystal display drives pixels in a signal-point polarity reversal manner. Wherein, the signal-point polarity reversal manner is that a voltage polarity stored in each pixel in the liquid crystal display opposites to the voltage polarities stored in the neighboring pixels around the pixel.

Further, each selection module selects data voltages of the corresponding group of data voltage set to provide to data lines in the corresponding group of data line set according to different control signals when the liquid crystal display drives pixels in a double-point polarity reversal manner. Wherein, the double-point polarity reversal manner is that a voltage polarity stored in each pixel set in the liquid crystal display opposites to the voltage polarities stored in the neighboring pixel sets around the pixel set, wherein each pixel set includes at least two pixels having the same voltage polarities.

Furthermore, each group of data voltage set includes: a first data voltage, a second data voltage, a third data voltage and a fourth data voltage; each group of data line set includes: a first data line, a second data line, a third data line and a fourth data line; and the control signal includes a high level signal and a low level signal; wherein each selection module selects the first data voltage, the second data voltage, the third data voltage and the fourth data voltage in the corresponding group of data voltage set to sequentially provide to the first data line, the second data line, the third data line and the fourth data line in the corresponding group of data line set according to the high level signal when the liquid crystal display drives pixels in the single-point polarity reversal manner.

Further, each selection module selects the first data voltage, the second data voltage, the third data voltage and the fourth data voltage in the corresponding group of data voltage set to sequentially provide to the first data line, the third data line, the second data line and the fourth data line in the corresponding group of data line set according to the low level signal when the liquid crystal display drives pixels in the double-point polarity reversal manner.

Furthermore, each group of data voltage set includes: a first data voltage, a second data voltage, a third data voltage and a fourth data voltage; each group of data line set includes: a first data line, a second data line, a third data line and a fourth data line; and the control signal includes a high level signal and a low level signal; wherein each selection module selects the first data voltage, the second data voltage, the third data voltage and the fourth data voltage in the corresponding group of data voltage set to sequentially provide to the first data line, the second data line, the third data line and the fourth data line in the corresponding group of data line set according to the low level signal when the liquid crystal display drives pixels in the single-point polarity reversal manner.

Further, each selection module selects the first data voltage, the second data voltage, the third data voltage and the fourth data voltage in the corresponding group of data voltage set to sequentially provide to the first data line, the third data line, the second data line and the fourth data line in the corresponding group of data line set according to the high level signal when the liquid crystal display drives pixels in the double-point polarity reversal manner.

Furthermore, the selection module at least includes: a first NMOS transistor, a first PMOS transistor, a second NMOS transistor and a second PMOS transistor; wherein input terminals of the first NMOS transistor and the first PMOS transistor are used to receive the second data voltage, input terminals of the second NMOS transistor and the second PMOS transistor are used to receive the third data voltage, an output terminal of the first PMOS transistor and an output terminal of second NMOS transistor are connected to the third data line, an output terminal of the second PMOS transistor and an output terminal of the first NMOS transistor are connected to the second data line, and control terminals of the first NMOS transistor, the first PMOS transistor, the second NMOS transistor and the second PMOS transistor are used to receive the control signals.

Furthermore, the selection module at least includes: a first NMOS transistor, a first PMOS transistor, a second NMOS transistor and a second PMOS transistor; wherein the input terminals of the first NMOS transistor and the first PMOS transistor are used to receive the second data voltage, the input terminals of the second NMOS transistor and the second PMOS transistor are used to receive the third data voltage, the output terminal of the first NMOS transistor and the output terminal of second PMOS transistor are connected to the third data line, the output terminal of the first PMOS transistor and the output terminal of the second NMOS transistor are connected to the second data line, and the control terminals of the first NMOS transistor, the first PMOS transistor, the second NMOS transistor and the second PMOS transistor are used to receive the control signals.

Another object of the present invention is also to provide a liquid crystal display including the abovementioned data controller.

The present invention has the following Advantageous effect: the liquid crystal display and the data driver thereof in the present invention may achieve the goal of free switching between the single-point polarity reversal manner and the double-point polarity reversal manner.

BRIEF DESCRIPTION OF THE DRAWINGS

These and/or other aspects, characteristics and advantages of the embodiments in the present disclosure will become apparent and more readily appreciated from the following description, taken in conjunction with the accompanying drawings in which.

DETAILED DESCRIPTION OF EXEMPLARY EMBODIMENTS

Figure 1:
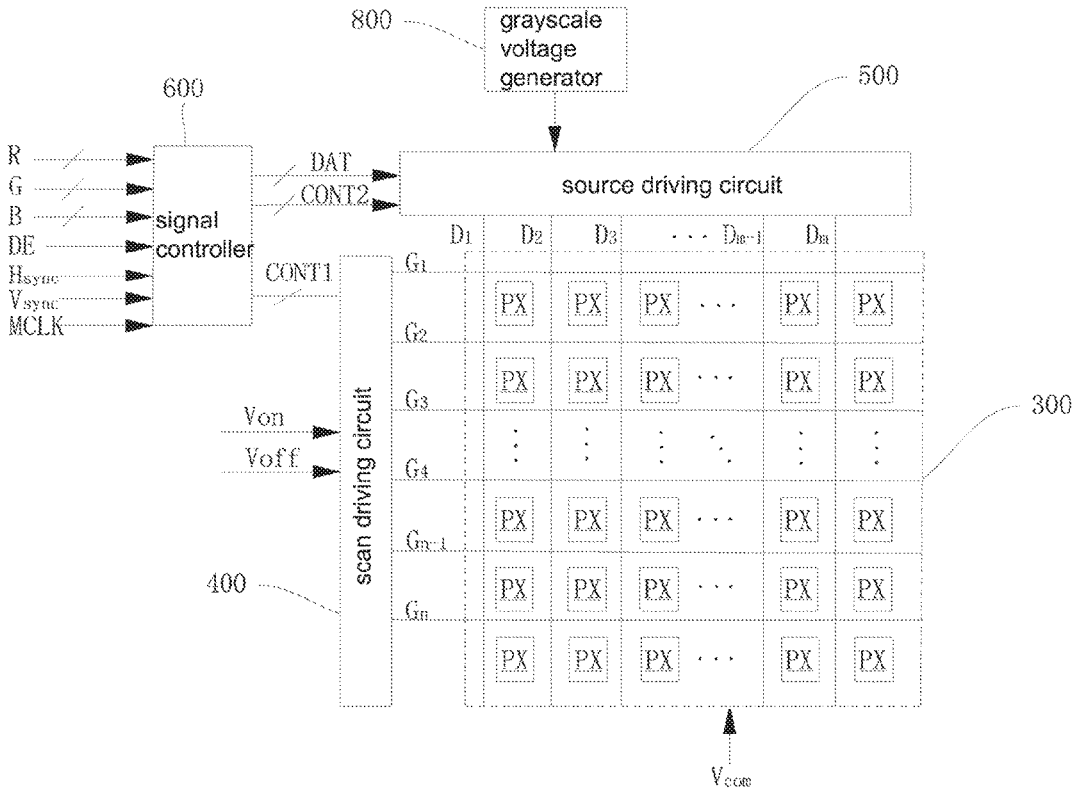
FIG. 1 illustrates a block diagram of the liquid crystal display according to an embodiment of the present invention.

Embodiments of the present invention will be described in detail below by referring to the accompany drawings. However, the present invention can be implemented in numerous different forms, and the present invention may not be explained to be limited hereto. Instead, these embodiments are provided for explaining the principle and actual application of the present invention, thus other skilled in the art can understand various embodiments and amendments which are suitable for specific intended applications of the present invention.

In the drawings, thicknesses of layers and regions are exaggerated in order to clear the device. The same reference sign always refers to the same element in the drawings.

It should be understood that although the terms "first" and "second" may be used to describe various kinds of elements, these elements should not be limited thereto. These terms are merely used to distinguish one element from another one.

FIG. 1 illustrates a block diagram of the liquid crystal display according to an embodiment of the present invention;

Referring to FIG. 1, the liquid crystal display according to an embodiment of the present invention includes: a liquid crystal panel assembly 300; a scan driver 400 and a data driver 500 being connected to the liquid crystal panel assembly 300; a grayscale voltage generator 800 connected to the data driver 500; and a signal controller 600 for controlling the liquid crystal panel assembly 300, the scan driver 400, the data driver 500 and the grayscale voltage generator 800.

The liquid crystal display assembly 300 includes a plurality of display signal lines and a plurality of pixels PX arranged in an array and connected to the display signal lines. The liquid crystal panel assembly 300 may include an lower display panel (not show) and an upper display panel (not show) facing with each other, and a liquid crystal layer (not show) inserted between the lower display panel and the upper display panel.

The display signal lines can be arranged on the lower display panel. The display signal lines may include a plurality of gate lines $G_1$ to $G_n$ for transmitting gate signals and a plurality of data lines $D_1$ to $D_m$ for transmitting data signals. The gate lines $G_1$ to $G_n$ extend in a row direction and are roughly parallel to each other, and the data lines $D_1$ to $D_m$ extend in a column direction and are roughly parallel to each other.

Each pixel PX includes: a switch device connected to the corresponding gate line and the corresponding data line; and a liquid crystal capacitor connected to the switch device. If necessary, each pixel PX may also include a storage capacitor, which is connected to the liquid crystal capacitor in parallel.

The switch device of each pixel PX is a three-terminal device, thus the switch device has a control terminal connected to the corresponding gate line, an input terminal connected the corresponding data line and an output terminal connected to the corresponding liquid crystal capacitor.

The scan driver 400 is connected to the gate lines $G_1$ to $G_n$ and applies gate signals to the gate lines $G_1$ to $G_n$. The gate signal is a combination of a high level gate signal (hereinafter named as gate turn-on voltage $V_{on}$) and a low level gate signal (hereinafter named as gate turn-off voltage $V_{off}$), which are provided to the scan driver 400 from an external source. Referring to FIG. 1, at one side of the liquid crystal panel assembly 300 is provided with scan drivers 400, and the gate lines $G_1$ to $G_n$ are connected to these scan drivers 400. However, the present invention is not limited thereto. That is to say, one scan driver can be provided at opposite sides of the liquid crystal panel assembly, and the gate lines $G_1$ to $G_n$ are connected to every one of these two scan drivers.

The grayscale voltage generator 800 generates a grayscale voltage that is closely related to the transmittance of the pixel PX. The grayscale voltage is provided to each pixel PX and has a positive value and a negative value according to a common voltage $V_{com}$.

The data driver 500 is connected to the data lines $D_1$ to $D_m$ of the liquid crystal panel assembly 300, and applies the grayscale voltage generated by the grayscale voltage generator 800 to the pixel PX as a data voltage. If the grayscale voltage generator 800 only supplies a reference grayscale voltage instead of supplying all the grayscale voltage, the data driver 500 will divide the reference grayscale voltage to generate various grayscale voltages and choose one of the various grayscale voltages as a data voltage.

The signal controller 600 controls operations of the scan driver 400 and the data driver 500.

The signal controller 600 receives input image signals (R, G and B) and a plurality of input control signals (such as a vertical synchronizing signal Vsync, a horizontal synchronizing signal Hsync, a master clock signal MCLK, and a data enable signal DE) for controlling display of the input image signals from an external graphic controller (not show). The signal controller 600 properly processes the input image signals (R, G and B) according to the input control signal, thereby generating image data DAT fitting for the operating condition of the liquid crystal panel assembly 300. The signal controller 600 then generates a gate control signal CONT1 and a data control signal CONT 2, and transmits the gate control signal CONT 1 to the scan driver 400 and transmits the data control signal CONT 2 and the image data DAT to the data driver 500.

The gate control signal CONT 1 may include: a scanning start signal STV for starting the operation (namely, scanning) of the scan driver 400; and at least one clock signal for controlling when to output the gate turn-on voltage $V_{on}$. The gate control signal CONT 1 may also include an output enable signal OE for limiting the duration of the gate turn-on voltage $V_{on}$. The clock signal can be used as selection signal SE.

The data control signal CONT 2 may include: a horizontal sync start signal STH, which indicates a transmission of the image data DAT; a loading signal LOAD, which requests to apply data voltages corresponding to the image data DAT to the data lines $D_1$ to $D_m$; and and a data clock signal HCLK. The data control signal CONT 2 may also include a reverse signal RVS for reversing a polarity of the data voltage relative to the common voltage $V_{com}$, and hereinafter it will be called "polarity of the data voltage".

The data driver 500 receives image data DAT from the signal controller 600 in response to the data control signal CONT 2, and selects a grayscale voltage corresponding to the image data DAT from plurality of grayscale voltages provided by the grayscale voltage generator 800 to convert the image data into a data voltage. Then, the data driver 500 supplies the data voltage to the data lines $D_1$ to $D_m$.

The scan driver 400 applies the gate turn-on voltage $V_{on}$ to the gate lines $G_1$ to $G_n$ in response to the gate control signal CONT 1, so as to turn on the switch devices connected to the gate lines $G_1$ to $G_n$. Then, the data voltage provided to the data lines $D_1$ to $D_m$ is transmitted to each pixel PX via the switch devices which is turned on.

A difference between the data voltage provided to each pixel PX and the common voltage $V_{com}$ can be interpreted as a voltage for charging the liquid crystal capacitor of each pixel PX, namely, a pixel voltage. The arrangement of the liquid crystal moleculars in the liquid crystal layer changes in accordance with the magnitude of the pixel voltage, thus the polarity of the light transmitted through the liquid crystal layer may also change, which causes a variation of the transmittance of the liquid crystal layer FIG. 2 illustrates a module diagram of the data driver according to an embodiment of the present invention.

Figure 2:
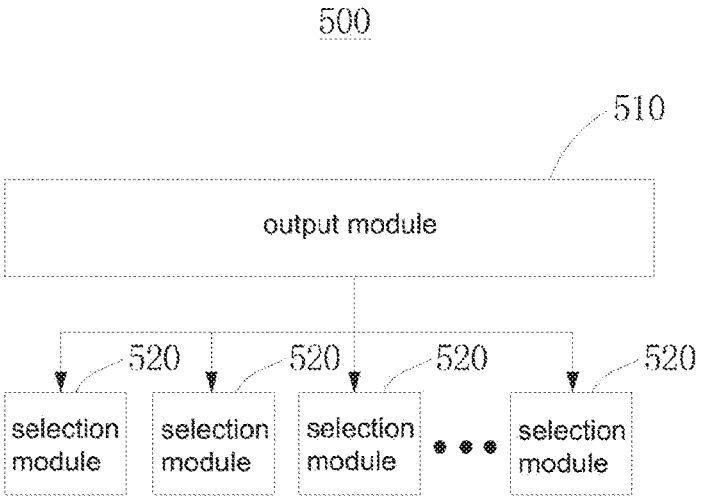
FIG. 2 illustrates a module diagram of the data driver according to an embodiment of the present invention.

Referring to FIG. 2, the data driver 500 according to an embodiment of the present invention includes: an output module 510 and N selection modules 520.

The output module 510 applies the grayscale voltages generated by the grayscale voltage generator 800 to the pixels PX as data voltages. If the grayscale voltage generator 800 only supplies a reference grayscale voltage instead of supplying all the grayscale voltage, the output module 510 will divide the reference grayscale voltage to generate various grayscale voltages and choose one of the grayscale voltages as a data voltage.

Furthermore, the output module 510 receives image data DAT from the signal controller 600 in response to the data control signal CONT 2, and selects a grayscale voltage corresponding to the image data DAT from plurality of grayscale voltages provided by the grayscale voltage generator 800 to convert the image data into a data voltage. Then, the output module 510 provides the data voltage to the data lines $D_1$ to $D_m$.

Here, m data lines $D_1$ to $D_m$ are grouped into N groups of data line set. Preferably, each group of data line set includes four data line: a first data line, a second data line, a third data line and a fourth data line. However, the present invention is not limited thereto.

Corresponding to the N groups of data line sets, m data voltages to be provided to the m data lines $D_1$ to $D_m$ are also grouped into N groups of data voltage sets. Accordingly, each data voltage set includes a first data voltage, a second data voltage, a third data voltage and a fourth data voltage. However, the present invention is not limited thereto.

So, the output module 510 outputs N groups of data voltage sets to the N groups of data line sets. Each one of the N selection modules 520 corresponds to a group of data voltage set and a group of data line set.

Each selection module 520 selects data voltages of the corresponding group of data voltage set to provide to data lines in the corresponding group of data line set according to different control signals B when the pixel is driven in different polarity reversal manners.

In particular, each selection module 520 selects data voltages in the corresponding group of data voltage set to provide to data lines in the corresponding group of data line set according to different control signals B when the pixel is driven in a way of single-point polarity reversal manner. The single-point polarity reversal manner refers to: a voltage polarity stored in each pixel is opposite to the voltage polarities stored in the neighboring pixels around the pixel.

Each selection module 520 selects data voltages in the corresponding group of data voltage set to provide to data lines in the corresponding group of data line set according to different control signals B when the pixel is driven in a way of double-point polarity reversal manner. The double-point polarity reversal manner refers to: a voltage polarity stored in every pixel set opposite to the voltage polarities stored in the neighboring pixel sets around the pixel set, and each pixel set includes at least two pixels having the same voltage polarities.

Figure 3:
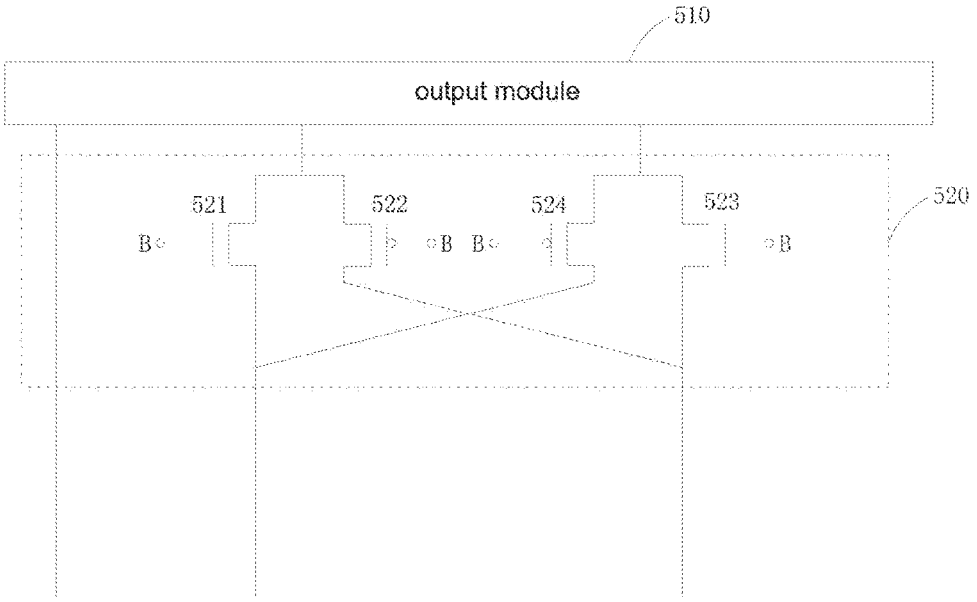
FIG. 3 illustrates a circuit diagram of the selection module according to an embodiment of the present invention.

FIG. 3 illustrates a circuit structure diagram of the selection module according to an embodiment of the present invention. In FIG. 3, an interpretation of a circuit stricture formed by using one selection module 520 and the corresponding four data lines and four data voltages is made. It should be understood that the circuit structures formed by other selection modules 520 and the corresponding four data lines and four date voltages thereof are also the same to that shown in FIG. 3.

Referring to FIG. 3, each selection module 520 includes: a first NMOS transistor 521, a first PMOS transistor 522, a second NMOS transistor 523 and a second PMOS transistor 524.

Input terminals of the first NMOS transistor 521 and the first PMOS transistor 522 are used to receive the second data voltage, and an output terminal of the first NMOS transistor 521 is connected to the second data line, and an output terminal of the first PMOS transistor 522 is connected to the third data line. Input terminals of the second NMOS transistor 523 and the second PMOS transistor 524 are used to receive the third data voltage, and an output terminal of the second NMOS transistor 523 is connected to the third data line, and an output terminal of the second PMOS transistor 524 is connected to the second data line. Control terminals of the first NMOS transistor 521, the first PMOS transistor 522, the second NMOS transistor 523 and the second PMOS transistor 524 are used to receive the control signals B.

In the present embodiment, the control signal B includes a high level signal and a low level signal, but the present invention is not limited thereto.

The principle of the selection module 520 is: when the pixel is driven in a way of single-point polarity reversal manner, the control terminals of the first NMOS transistor 521 and the second NMOS transistor 523 receives the high level signal and are turned on, while the control terminals of the first PMOS transistor 522 and the second PMOS transistor 524 are turned off due to receiving the high level signal, thus the first to fourth data voltages are sequentially provided to the first to fourth data lines.

When the pixel is driven in a way of double-point polarity reversal manner, the control terminals of the first NMOS transistor 521 and the second NMOS transistor 523 receives the low level signal and thus turned off, while the control terminals of the first PMOS transistor 522 and the second PMOS transistor 524 are turned on due to receiving the low level signal, thus the first data voltage, the second data voltage, the third data voltage and the fourth data voltage are sequentially provided to the first data line, the third data line, the second data line and the fourth data line.

Figure 4:
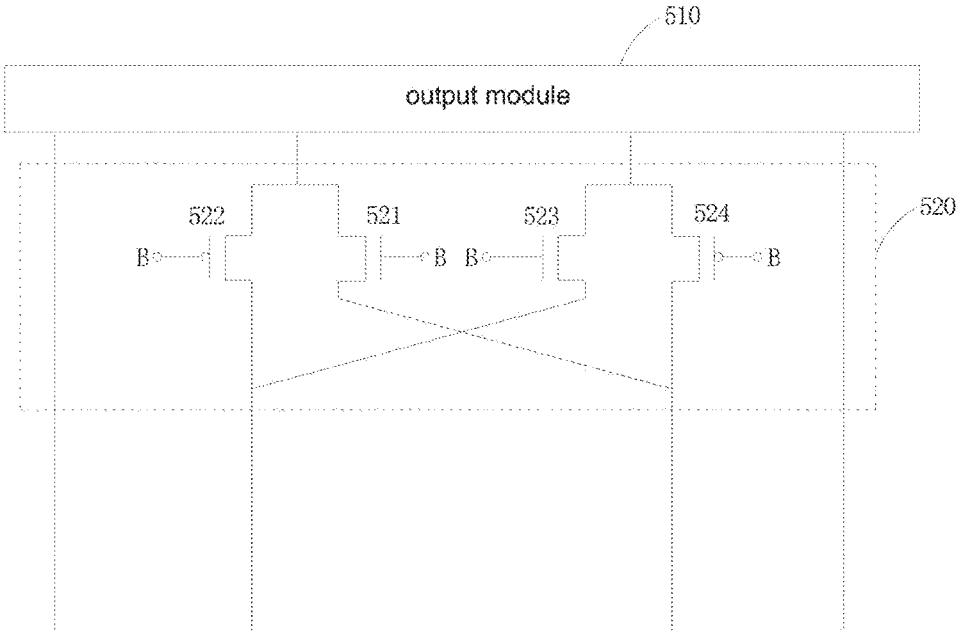
FIG. 4 illustrates a circuit structure diagram of the selection module according to another embodiment of the present invention.

FIG. 4 illustrates a circuit structure diagram of the selection module according to another embodiment of the present invention.

Referring to FIG. 4, the circuit structure of the selection module shown in FIG. 4 is different from that shown in FIG. 3 in that: input terminals of the first NMOS transistor 521 and the first PMOS transistor 522 are used to receive the second data voltage, and an output terminal of the first PMOS transistor 522 is connected to the second data line, and an output terminal of the first NMOS transistor 521 is connected to the third data line; input terminals of the second NMOS transistor 523 and the second PMOS transistor 524 are used to receive the third data voltage, and an output terminal of the second PMOS transistor 524 is connected to the third data line, and an output terminal of the second NMOS transistor 523 is connected to the second data line; and control terminals of the first NMOS transistor 521, the first PMOS transistor 522, the second NMOS transistor 523 and the second PMOS transistor 524 are used to receive the control signals B.

The principle of the selection module 520 is: when the pixel is driven in a way of single-point polarity reversal, the control terminals of the first NMOS transistor 521 and the second NMOS transistor 523 are turned off for receiving the low level signal, while the control terminals of the first PMOS transistor 522 and the second PMOS transistor 524 are turned on for receiving the low level signal, thus the first to fourth data voltages are sequentially provided to the first to fourth data lines.

When the pixel is driven in a way of double-point polarity reversal manner, the control terminals of the first NMOS transistor 521 and the second NMOS transistor 523 are turned on for receiving the high level signal, while the control terminals of the first PMOS transistor 522 and the second PMOS transistor 524 are turned off due to receiving the high level signal, thus the first data voltage, the second data voltage, the third data voltage and the fourth data voltages are sequentially provided to the first data line, the third data line, the second data line and the fourth data line.

In conclusion, the liquid crystal display and the data driver thereof according to the present invention may achieve the goal of free switching between the single-point polarity reversal manner and the double-point polarity reversal manner.

Although the present disclosure is described with reference to the special embodiments, while those skilled in the art will understand: various changes in form and details may be made therein without departing from the spirit and scope of the invention as defined by the appended claims and its equivalents.

The invention claimed is:

1. A data driver for a liquid crystal display, comprising:

a plurality of output terminals for outputting N groups of data voltage sets to N groups of data line sets; and N selection switches, each one corresponding to one group of data voltage set and one group of data line set, the selection switches configured to operate pixels in at least two different polarity reversal manners;

wherein each selection switch selects data voltages of the corresponding group of data voltage set to provide to data lines in the corresponding group of data line set according to different control signals;

wherein each selection switch selects data voltages of the corresponding group of data voltage set to provide to data lines in the corresponding group of data line set according to different control signals when the liquid crystal display drives pixels in a double-point polarity reversal manner; and wherein the double-point polarity reversal manner is a voltage polarity stored in each pixel set in the liquid crystal display opposites to the voltage polarities stored in the neighboring pixel sets around the pixel set, wherein each pixel set includes at least two pixels having the same voltage polarities.

2. The data driver of claim 1, wherein each selection switch selects the data voltage of the corresponding group of data voltage set to provide to data lines in the corresponding group of data line set according to different control signals when the liquid crystal display drives pixels in a single-point polarity reversal manner;

wherein the single-point polarity reversal manner is: a voltage polarity stored in each pixel in the liquid crystal display opposites to the voltage polarities stored in the neighboring pixels around the pixel.

3. The data driver of claim 2, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first PMOS transistor and an output terminal of second NMOS transistor are connected to the third data line, an output terminal of the second PMOS transistor and an output terminal of the first NMOS transistor are connected to the second data line, and control terminals of the first NMOS transistor, the first PMOS transistor, the second NMOS transistor and the second PMOS transistor are used to receive the control signals.

4. The data driver of claim 2, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first NMOS transistor and an output terminal of second PMOS transistor are connected to the third data line, an output terminal of the first PMOS transistor and an output terminal of the second NMOS transistor are connected to the second data line, and control terminals of the first NMOS transistor, the first PMOS transistor, the second NMOS transistor and the second PMOS transistor are used to receive the control signals.

5. The data driver of claim 1, wherein each group of the data voltage set comprises: a first data voltage, a second data voltage, a third data voltage and a fourth data voltage; each group of the data line set comprises: a first data line, a second data line, a third data line and a fourth data line; and the control signal comprises a high level signal and a low level signal;

wherein each selection switch selects the first data voltage, the second data voltage, the third data voltage and the fourth data voltage in the corresponding group of data voltage set to sequentially provide to the first data line, the second data line, the third data line and the fourth data line in the corresponding group of data line set according to the high level signal when the liquid crystal display drives pixels in the single-point polarity reversal manner.

6. The data driver of claim 5, wherein each selection switch selects the first data voltage, the second data voltage, the third data voltage and the fourth data voltage in the corresponding group of data voltage set to sequentially provide to the first data line, the third data line, the second data line and the fourth data line in the corresponding group of data line set according to the low level signal when the liquid crystal display drives pixels in the double-point polarity reversal manner.

7. The data driver of claim 5, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first PMOS transistor and an output terminal of second NMOS transistor are connected to the third data line, an output terminal of the second PMOS transistor and an output terminal of the first NMOS transistor are connected to the second data line, and control terminals of the first NMOS transistor, the first PMOS transistor, the second NMOS transistor and the second PMOS transistor are used to receive the control signals.

8. The data driver of claim 6, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first PMOS transistor and an output terminal of second NMOS transistor are connected to the third data line, an output terminal of the second PMOS transistor and an output terminal of the first NMOS transistor are connected to the second data line, and control terminals of the first NMOS transistor, the first PMOS transistor, the second NMOS transistor and the second PMOS transistor are used to receive the control signals.

9. The data driver of claim 1, wherein each group of the data voltage set comprises: a first data voltage, a second data voltage, a third data voltage and a fourth data voltage; each group of the data line set comprises: a first data line, a second data line, a third data line and a fourth data line; and the control signal comprises a high level signal and a low level signal;

wherein each selection switch selects the first data voltage, the second data voltage, the third data voltage and the fourth data voltage in the corresponding group of data voltage set to sequentially provide to the first data line, the second data line, the third data line and the fourth data line in the corresponding group of data line set according to the low level signal when the liquid crystal display drives pixels in the single-point polarity reversal manner.

10. The data driver of claim 9, wherein each selection switch selects the first data voltage, the second data voltage, the third data voltage and the fourth data voltage in the corresponding group of data voltage set to sequentially provide to the first data line, the third data line, the second data line and the fourth data line in the corresponding group of data line set according to the high level signal when the liquid crystal display drives pixels in the double-point polarity reversal manner.

11. The data driver of claim 9, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first NMOS transistor and an output terminal of second PMOS transistor are connected to the third data line, an output terminal of the first PMOS transistor and an output terminal of the second NMOS transistor are connected to the second data line, and control terminals of the first NMOS transistor, the first PMOS transistor, the second NMOS transistor and the second PMOS transistor are used to receive the control signals.

12. The data driver of claim 10, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first NMOS transistor and an output terminal of second PMOS transistor are connected to the third data line, an output terminal of the first PMOS transistor and an output terminal of the second NMOS transistor are connected to the second data line, and control terminals of the first NMOS transistor, the first PMOS transistor, the second NMOS transistor and the second PMOS transistor are used to receive the control signals.

13. The data driver of claim 1, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first PMOS transistor and an output terminal of second NMOS transistor are connected to the third data line, an output terminal of the second PMOS transistor and an output terminal of the first NMOS transistor are connected to the second data line, and control terminals of the first NMOS transistor, the first PMOS transistor, the second NMOS transistor and the second PMOS transistor are used to receive the control signals.

14. The data driver of claim 1, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first PMOS transistor and an output terminal of second NMOS transistor are connected to the third data line, an output terminal of the second PMOS transistor and an output terminal of the first NMOS transistor are connected to the second data line, and control terminals of the first NMOS transistor, the first PMOS transistor, the second NMOS transistor and the second PMOS transistor are used to receive the control signals.

15. The data driver of claim 1, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first NMOS transistor and an output terminal of second PMOS transistor are connected to the third data line, an output terminal of the first PMOS transistor and an output terminal of the second NMOS transistor are connected to the second data line, and control terminals of the first NMOS transistor, the first PMOS transistor, the second NMOS transistor and the second PMOS transistor are used to receive the control signals.

16. The data driver of claim 1, wherein the selection switch at least comprises: a first NMOS transistor, a first PMOS transistor, a second NMOS transistor and a second PMOS transistor;

wherein input terminals of the first NMOS transistor and the first PMOS transistor are used to receive the second data voltage, input terminals of the second NMOS transistor and the second PMOS transistor are used to receive the third data voltage, an output terminal of the first NMOS transistor and an output terminal of second PMOS transistor are connected to the third data line, an output terminal of the first PMOS transistor and an output terminal of the second NMOS transistor are connected to the second data line, and control terminals of the first NMOS transistor, the first PMOS transistor, the second NMOS transistor and the second PMOS transistor are used to receive the control signals.

17. A liquid crystal display comprising a data controller, wherein the data controller comprises:

a plurality of output terminals for outputting N groups of data voltage sets to N groups of data line sets; and N selection switches, each one corresponding to one group of data voltage set and one group of data line set, the selection switches configured operate pixels in at least two different polarity reversal manners;

wherein each selection switch selects data voltages of the corresponding group of data voltage set to provide to data lines in the corresponding group of data line set according to different control signals;

wherein each selection switch selects data voltages of the corresponding group of data voltage set to provide to data lines in the corresponding group of data line set according to different control signals when the liquid crystal display drives pixels in a double-point polarity reversal manner; and wherein the double-point polarity reversal manner is a voltage polarity stored in each pixel set in the liquid crystal display opposites to the voltage polarities stored in the neighboring pixel sets around the pixel set, wherein each pixel set includes at least two pixels having the same voltage polarities.

* * * * *